US006779317B2

(12) United States Patent
Wilhelm et al.

(10) Patent No.: US 6,779,317 B2
(45) Date of Patent: Aug. 24, 2004

(54) FOOD CONTAINER CLEANER APPARATUS AND METHOD

(75) Inventors: Robert F. Wilhelm, Dakota Dunes, SD (US); John E. Johnson, Jefferson, SD (US)

(73) Assignee: Tyson Fresh Meats, Inc., Springdale, AK (US)

( * ) Notice: Subject to any disclaimer, the term of this patent is extended or adjusted under 35 U.S.C. 154(b) by 0 days.

(21) Appl. No.: 10/248,102

(22) Filed: Dec. 18, 2002

(65) Prior Publication Data

US 2003/0136088 A1 Jul. 24, 2003

Related U.S. Application Data

(60) Provisional application No. 60/351,722, filed on Jan. 24, 2004.

(51) Int. Cl.[7] ..... B65B 51/10; B65B 61/00

(52) U.S. Cl. ..... 53/329.3; 53/167; 53/467; 15/56; 15/256.51

(58) Field of Search ..... 53/425, 426, 453, 53/456, 467, 473, 477, 141, 167, 559, 329.2, 329.3, 370.7, 373.7, 393, 52, 501, 495; 15/56, 63, 74, 77, 3.16, 3.17, 97.1, 102, 256.51; 101/425

(56) References Cited

U.S. PATENT DOCUMENTS

| | | | | | |
|---|---|---|---|---|---|
| 3,641,605 | A | * | 2/1972 | Lindsay | 15/1.51 |
| 4,205,410 | A | | 6/1980 | Heller et al. | 15/101 |
| 4,409,775 | A | | 10/1983 | Brody et al. | 53/167 |
| 4,642,971 | A | * | 2/1987 | Gilkey | 53/435 |
| 4,771,903 | A | * | 9/1988 | Levene et al. | 53/478 |
| 4,811,448 | A | | 3/1989 | Yagi | 15/211 |
| 4,883,542 | A | * | 11/1989 | Voneiff | 15/56 |
| 4,920,880 | A | * | 5/1990 | Hara et al. | 15/256.51 |
| 5,042,540 | A | * | 8/1991 | Gorlich | 141/174 |
| 5,097,653 | A | * | 3/1992 | Soloman | 53/495 |
| 5,195,294 | A | | 3/1993 | Baranowski | 53/167 |
| 5,195,298 | A | | 3/1993 | Baranowski | 53/425 |
| 5,334,405 | A | | 8/1994 | Gorlich | 426/396 |
| 5,447,736 | A | | 9/1995 | Gorlich | 426/396 |
| 5,664,677 | A | | 9/1997 | O'Connor | 206/494 |
| 5,848,341 | A | * | 12/1998 | Watanabe | 15/256.51 |
| 5,875,587 | A | | 3/1999 | Stevens | 47/1.5 |
| 5,879,094 | A | | 3/1999 | Lersch et al. | 401/139 |
| 6,041,711 | A | * | 3/2000 | Oyaizu et al. | 101/425 |
| 6,176,183 | B1 | * | 1/2001 | Oyaizu et al. | 101/425 |
| 6,193,357 | B1 | | 2/2001 | Medin | 347/33 |
| 6,198,887 | B1 | | 3/2001 | Sato | 399/64 |
| 6,681,550 | B1 | * | 1/2004 | Aylward | 53/495 |

* cited by examiner

*Primary Examiner*—John Sipos
*Assistant Examiner*—Louis Huynh
(74) *Attorney, Agent, or Firm*—Blackwell Sanders Peper Martin LLP; Mark E. Stallion

(57) ABSTRACT

An apparatus is provided for effecting the formation of a packaged food product with the food being contained within a receptacle having a cover adhered to the receptacle. Prior to securing the cover to the receptacle, the surface that is to be sealed to the cover is cleaned by wiping with towel material. The towel material is advanced from a supply to a cleaning position to wipe a cover engaging surface to remove at least a portion of contaminants or foreign material present on the container, thereby improving adhesion of the cover to the receptacle. Towel material can be advanced from time to time from the supply to a take-up mechanism to present clean or fresh towel material at predetermined intervals. A method for cleaning container-sealing surfaces is also provided.

14 Claims, 17 Drawing Sheets

FOOD CONTAINER CLEANER APPARATUS AND METHOD

CROSS REFERENCE TO RELATED APPLICATIONS

This application claims the benefit of U.S. Provisional Patent Application Ser. No. 60/351,722, filed Jan. 24, 2002, pending.

BACKGROUND OF INVENTION

The present invention relates, generally, to product packaging, and, more particularly, to an apparatus and related method for automatically packaging food items, and especially cuts of meat, in such a manner as to automatically clean the food container before it is sealed.

There is a product line in the food industry that is generally referred to as case-ready product. Case-ready product can include meat and vegetables, as well as other food products, packaged in containers including a receptacle and a cover. The cover is preferably clear for viewing the product in the container. Often, the product is fresh and needs to be maintained in an environment that prevents contamination and premature spoilage. Case-ready product containers preferably include a plastic sheet cover substantially the same size as the receptacle opening wherein the cover is sealed to an upper portion of the receptacle. In another type of case-ready container, the cover is wrapped around the receptacle and heat shrunk to form a seal. The wrap around-type cover utilizes significantly more cover material than a cover that is substantially the same size as the opening to the receptacle. Either form of case-ready product provides a sealed environment inside the receptacle and a package that is aesthetically and functionally pleasing to the end consumer.

The interiors of case-ready containers, because they are sealed, can be flushed with various gases to help preserve the freshness of the food product to extend shelf life. Shelf life is important to both food processors, retailers and consumers in order to reduce costs and to provide safety for the end consumer.

In case ready products where the cover is heat-sealed to an upper portion of the receptacle, the use of flushing gases is particularly important because of the integrity of the seal. Machines have been designed to introduce a gas into the container while simultaneously heat sealing a durable film on the tops of lips of the receptacles that tend to be polymeric (plastic) tray-type receptacles. The machines include sealing bars that apply pressure and heat to the film creating a heat seal to secure the cover to the receptacle. When executed correctly, a pillow of gas is captured under the covering film. In cases where a good seal is not formed between the tray and cover, for example by the presence of moisture, fat and/or protein on the sealing area, a seal will not properly form and the product will have to be reworked. This adds to the cost of producing products and/or elevates the risk of premature failure of the product. Reworking requires that the tray be removed from the production line to a rework area. The cover film is removed from the tray and the tray placed into the machine for reprocessing, and typically requires a worker to remove foreign materials such as moisture, protein and/or fat from the sealing area.

Currently in the meat industry, operators manually wipe the tops of receptacles with towels. The use of operators for cleaning receptacles is expensive and sometimes results in receptacles being missed or not cleaned uniformly. In addition, when operators use towels to manually remove contaminants from the receptacles, it is up to the individual operator to determine when a towel should be disposed of and a new towel used. This can lead to sporadic quality of cleaning and can introduce the transfer of bacteria and other towel contaminants between and into receptacles.

It is also known in the food processing industry to utilize air jets to clean the tops of containers prior to sealing. This method can be successfully used with food products that tend to leave loose particulate matter or water on the sealing surface of the receptacles. However, contaminants such as proteins, fats and starches adhere more securely to the sealing surfaces. Air streams are not effective for the removal of these contaminants, to a point where sealing can be effected.

Thus, there is a need for an improved apparatus and method for cleaning the sealing surface of food receptacles that overcomes the aforementioned problems.

SUMMARY OF INVENTION

In one aspect of the present invention a cleaning apparatus for cleaning a portion of at least one container is disclosed. The apparatus comprises a container cleaner including a wiping material supply mechanism to support a supply of wiping material. An engaging mechanism is operable to urge the wiping material from the supply mechanism into contact with the portion of the container to be cleaned. A wiping material take-up mechanism is adapted to store the wiping material from the supply mechanism after the wiping material has contacted the containers, and a drive is operable to effect movement of the wiping material from the supply mechanism to the take-up mechanism.

Another aspect of the present invention is to provide a food packaging apparatus. The packaging apparatus comprises a conveyor operable for advancing food receptacles from a filling station to a sealing station. A container cleaner is positioned between the filling station and the sealing station, and the cleaner includes a wiping material supply mechanism to support a supply of wiping material. An engaging mechanism is operable to urge the wiping material from the supply mechanism into contact with an upper rim of each of the food receptacles passing thereunder. A wiping material take-up mechanism is adapted to store the wiping material from the supply mechanism after the wiping material has contacted the food receptacles. A drive is operable to effect movement of the wiping material from the supply mechanism to the take-up mechanism.

Yet another aspect of the present invention is to provide a method of filling and sealing food containers. The method includes placing a food product into a receptacle, the receptacle having a cover engaging surface, and advancing the filled receptacle to a cleaning station. The cover-engaging surface is then contacted with a wiping material to remove at least a portion of any contaminant present on the cover-engaging surface. The wiping material is then advanced from a supply of wiping material to a take-up mechanism and a cover is adhered to the receptacle at the cover-engaging surface.

BRIEF DESCRIPTION OF DRAWINGS

The same numerals throughout the various figures designate the same or similar components.

DETAILED DESCRIPTION

Figure 1:
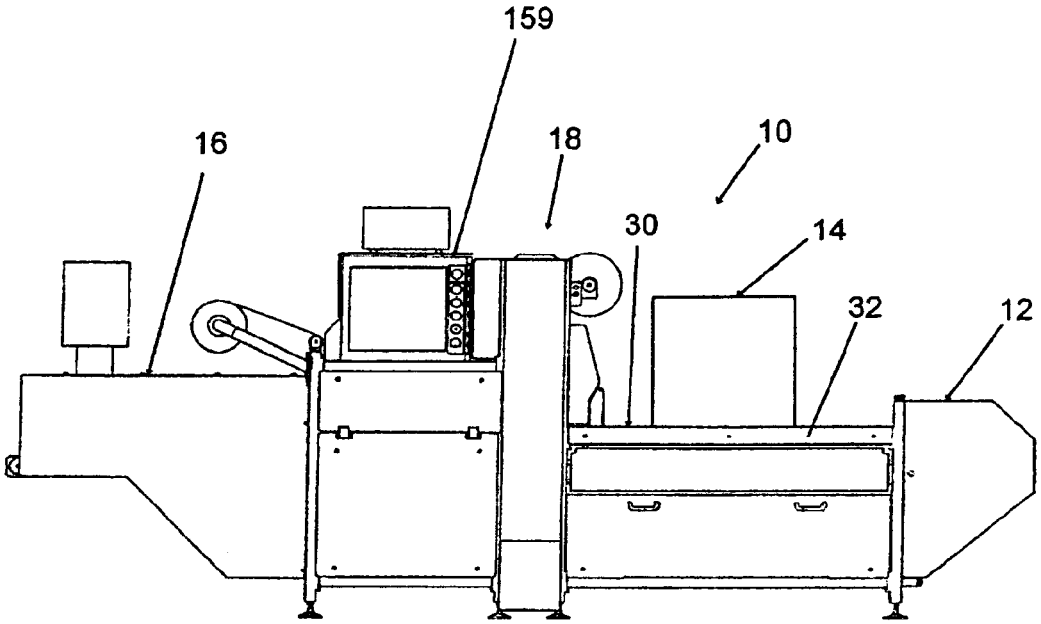
FIG. 1 is a schematic illustration of the food packaging apparatus of the present invention.
Figure 16:
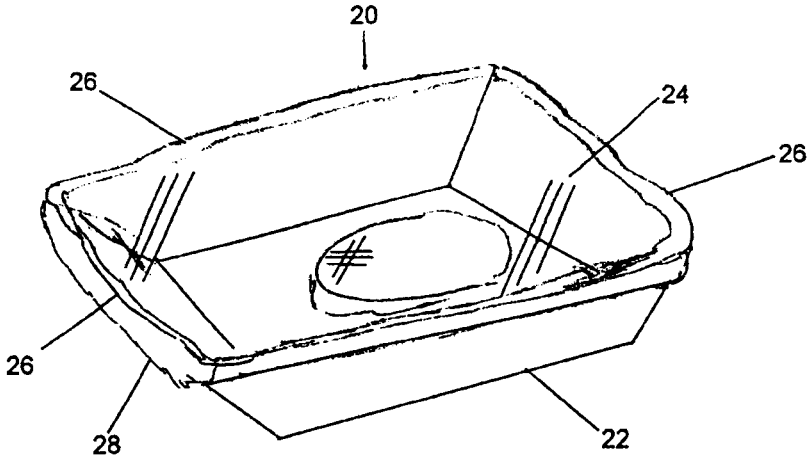
FIG. 16 is a perspective schematic view of a food container showing the receptacle and cover secured thereto after passing through the packing apparatus of the present invention.

A food packaging apparatus generally designated 10 is illustrated in FIG. 1. The apparatus comprises a food deposition station 12, cleaner 14, conveyor 16 and an assembly station 18. It is to be understood that throughout the drawings sizes of certain elements may vary in different figures and that some elements may be omitted from some views, for simplicity of the drawings, or may be shown as an alternative structure, as described hereafter. The apparatus is used to package food in containers, such as those shown in FIG. 16, for example. The food containers are generally designated 20, and most often formed as a receptacle 22, typically a polymeric (plastic) or polymeric coated tray. A cover 24 is secured to the receptacle 22, preferably at an upper cover-engaging surface 26 of lip 28 that extends around the perimeter of the receptacle. The cover 24 is secured to the surface 26 by any suitable means, including by adhesion or heat fusion. The cover 24 is preferably a transparent or translucent flexible plastic film piece that can be attached to receptacle 22 by the application of heat, as is known in the art. The attachment of such covers 24 to receptacles 22 is well known in the industry.

The receptacle 22 and cover 24 are joined together in the assembly station 18 shown in FIG. 1. One useful example of such an assembly station is a Ross-Riser 3320 Impact Sealing Machine by Ross Industries, Midland, Va., although other suitable assembly stations are known to those in the art. Food is deposited into receptacle 22 at the food deposition station 12. The food may be a single mass or may be discreet pieces, such as cut chicken, pork chops, pork steaks, vegetables or the like. The apparatus 10 is particularly adapted for use with meat products and particularly meat products that deposit one or more discreet pieces of meat into a receptacle 22 prior to securing a cover 24 to the receptacle. In the case of discreet pieces of meat, the meat is typically placed in the containers manually. However, other food products may be deposited automatically, as is known in the art.

Figure 2:
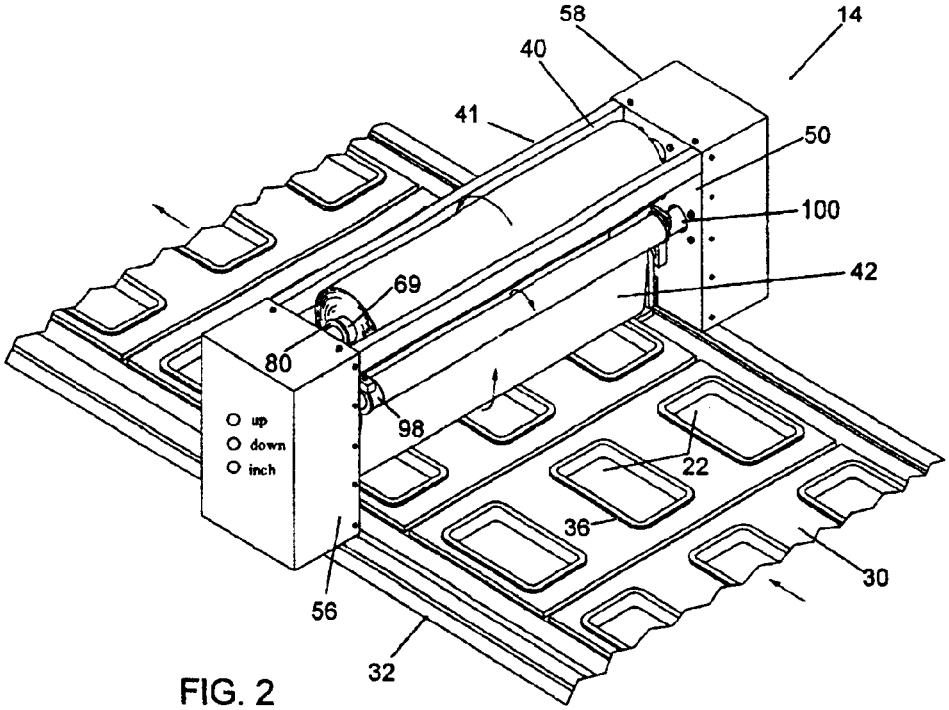
FIG. 2 is a fragmentary perspective view of the receptacle cleaner of the present invention shown from the upstream side for receptacle advancement.
Figure 3:
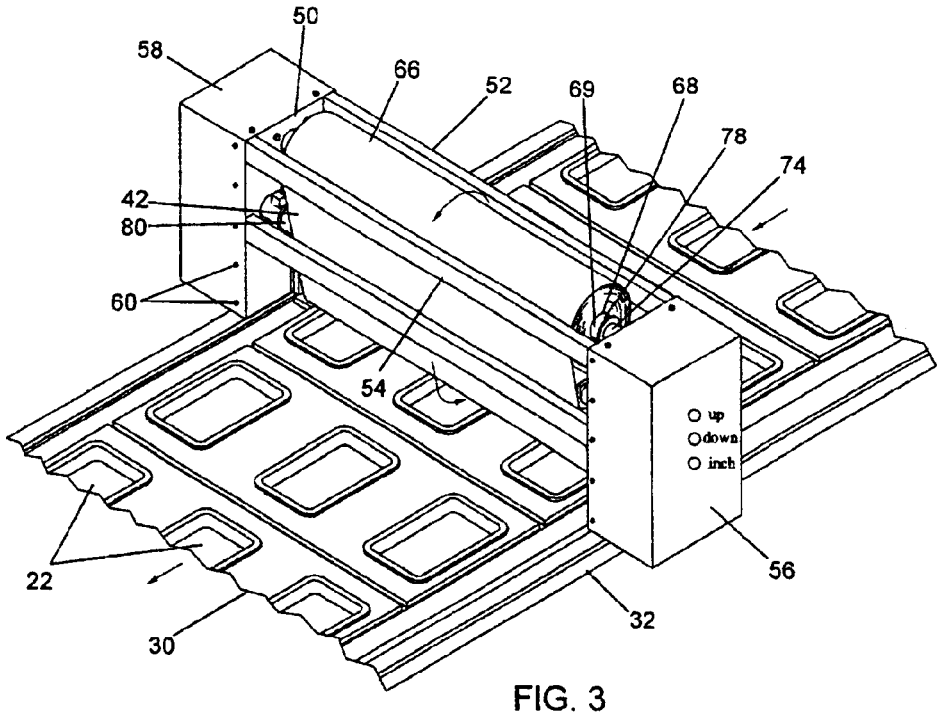
FIG. 3 is the cleaner of FIG. 2, except viewed from the downstream side.
Figure 4:
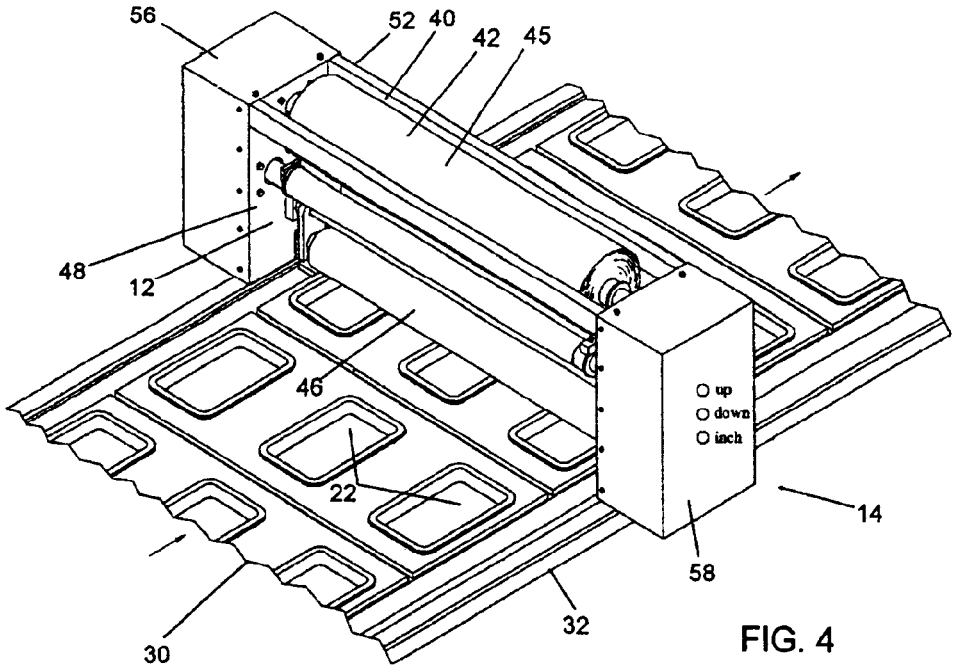
FIG. 4 is the cleaner of FIG. 2 with a portion of the towel material missing to show details of a presser and take-up mechanism.

A conveyor, designated generally 16, advances filled receptacles from the deposition station 12 through a cleaner station, designated generally 14, and then to the assembly station 18. The conveyor 16 is power operated and preferably moves incrementally, although continuous motion may be used, between the deposition station 12 and assembly station 18. The conveyor 16 includes a conveyor element (or "platen") 30, supported by a frame 32 and driven by a motor. Conveyor element 30 includes a plurality of pockets 36 (as shown in FIG. 2) arranged in columns along the length of the conveyor in the direction of movement of the conveyor element and rows that extend generally transverse to the direction of movement of the conveyor element. The pockets 36 are each sized and shaped to receive therein a receptacle 22 with the receptacle outwardly extending peripheral lip 28 which rests on the conveyor around the periphery of a respective pocket for support of the receptacle as it is advanced through the apparatus 10. The conveyor element 30 is power driven as by a suitable motor and controller (not shown), such as a microprocessor and/or programmable logic control, all housed within a cabinet within frame 32, generally beneath cleaner 14.

Other forms of conveyor elements 30 may be utilized in the present invention as are known in the art or which may yet be developed. Moreover, apparatus 10 is not to be considered for use only for packaging meat, but other food items as well. For example, platen 30 can be shaped to carry other items, such as bowls of soup, rather than rectangular trays. It can also be adapted for clean processing of food items sold in plastic bags or pouches, such as those formed from a continuous film supply, as one example.

In addition, apparatus 10 may be equipped with a system to detect mis-loads (not shown), as is known in the art. A typical system may include a photo-eye to detect mis-loaded trays. An automatic shut-down of tray motion and a mechanism to automatically lift the wiper roller pneumatically (instead of by the usual manual technique) would then allow clearing of mis-loaded food trays. A switch to disable the photo-eye during removal of the mis-loaded trays or to permit wash-down can be provided and a reset button can also be included to permit resuming operations under the original settings.

Cleaner 14, shown in detail in FIGS. 2 through 14, includes a frame, generally designated 38 (FIGS. 2 and 12) that supports a wiping material supply mechanism generally designated 40 that supports clean wiping or towel material 42. Frame 38 also supports a wiping material take-up mechanism generally designated 44 that receives used towel material 42. Preferably the take up mechanism 44 is upstream of the supply 40 and moves towel material 42 in an upstream direction opposite to the direction the receptacles 22 advance. Any slack in the towel material will be "picked up" by the mechanism illustrated in FIG. 15.

Frame 38 further supports an engaging mechanism or presser 46 (FIG. 13) that is operable to urge engagement of the towel material 42 with the surfaces 26 as the receptacles 22 pass under the presser 46.

Cleaner 14 is constructed, in a preferred embodiment, to help effect relative movement between the towel material 42 and the surfaces 26 as the receptacles 22 advance from the deposition station 12 to the assembly station 18. During relative movement between the towel material 42 and the surfaces 26 a substantial amount of the debris or contaminants is physically wiped and removed from the surfaces 26.

Figure 5:
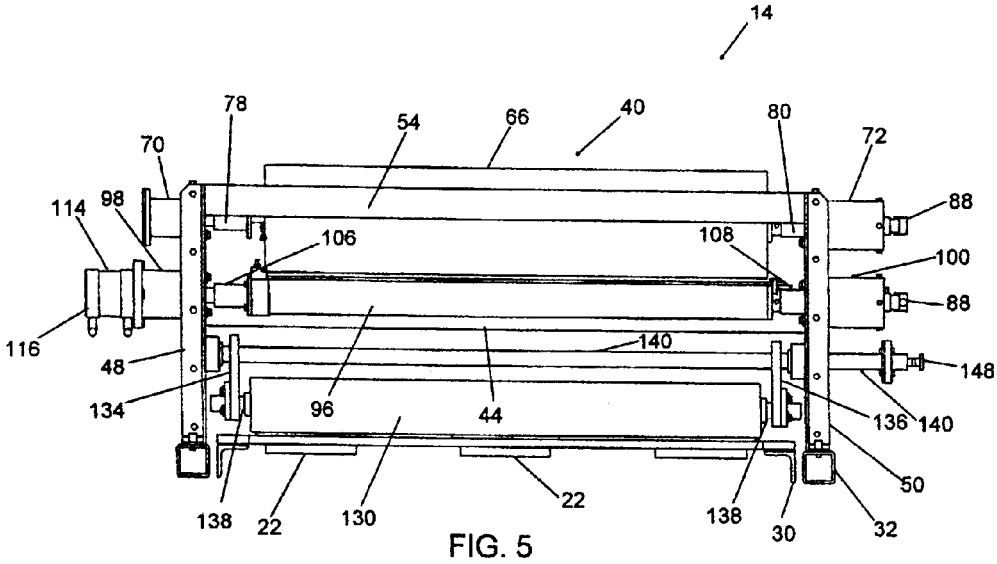
FIG. 5 is a side elevation view of the cleaner of FIG. 2, as viewed from the downstream side.
Figure 6:
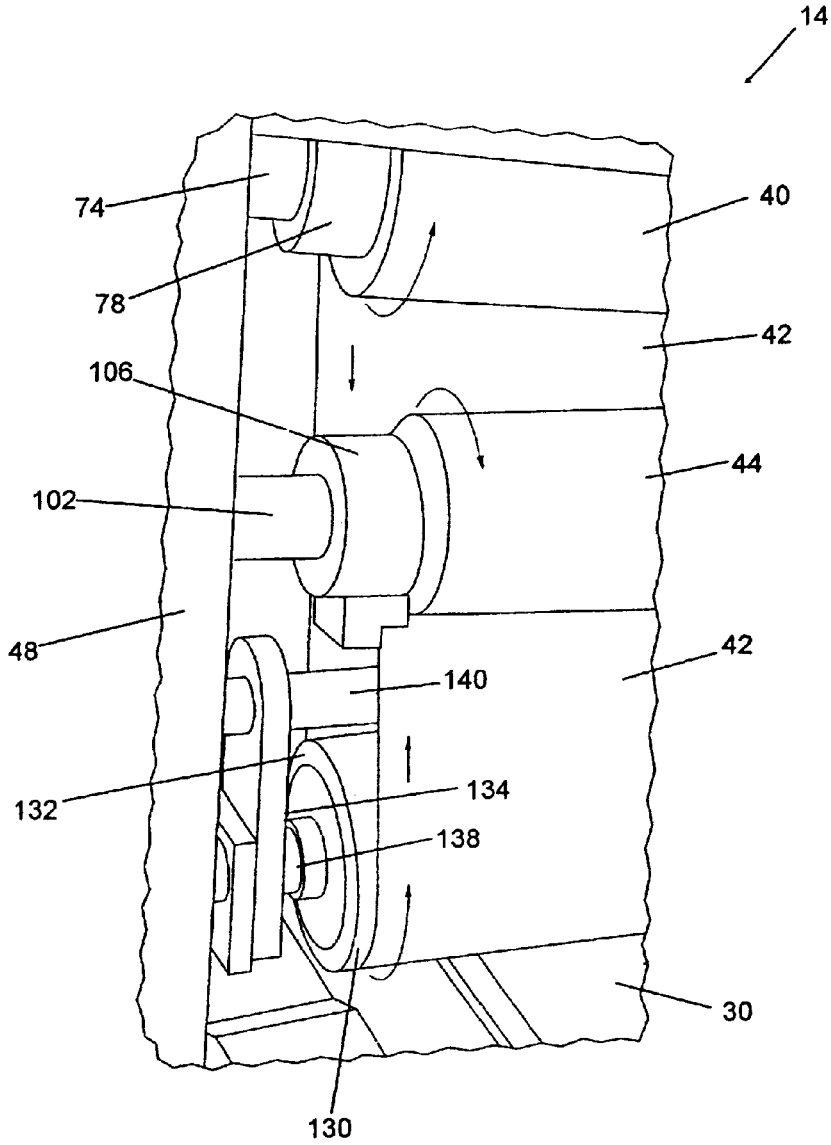
FIG. 6 is a fragmentary perspective view of the cleaner of FIG. 2 showing details of the towel supply and take-up mechanism as viewed from the upstream side.
Figure 7:
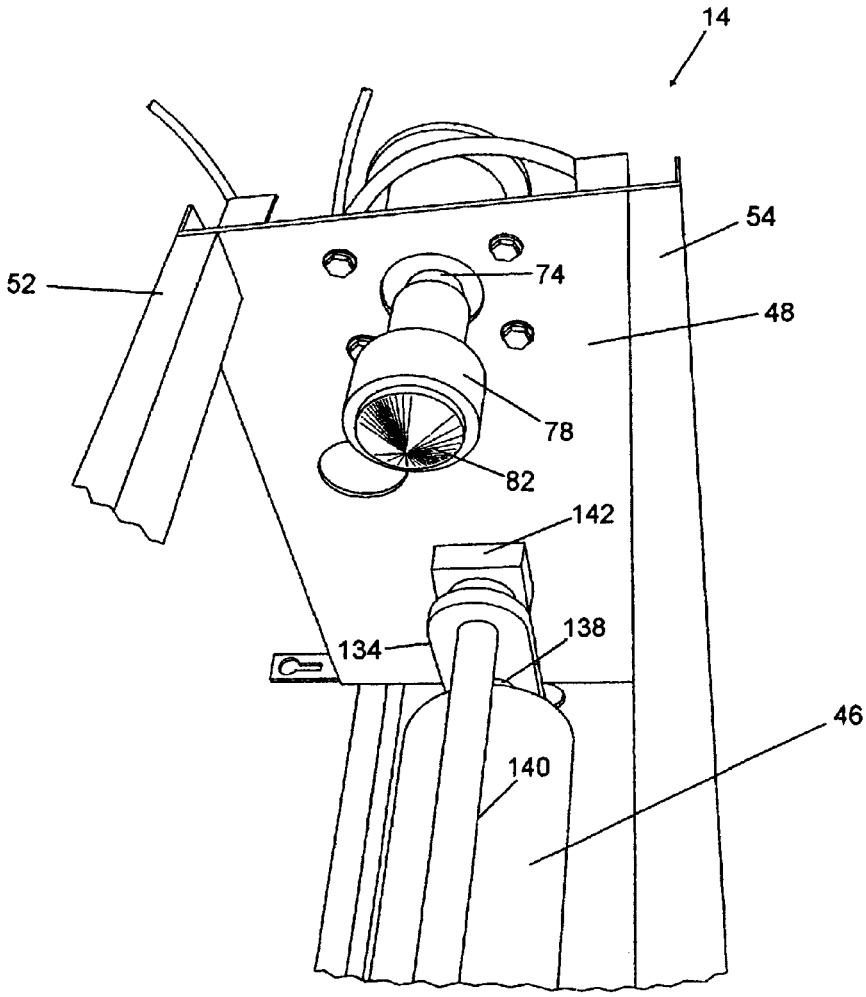
FIG. 7 is a fragmentary perspective view of the cleaner of FIG. 2 viewing the cleaner from the top with the left-hand side being on the upstream side.
Figure 8:
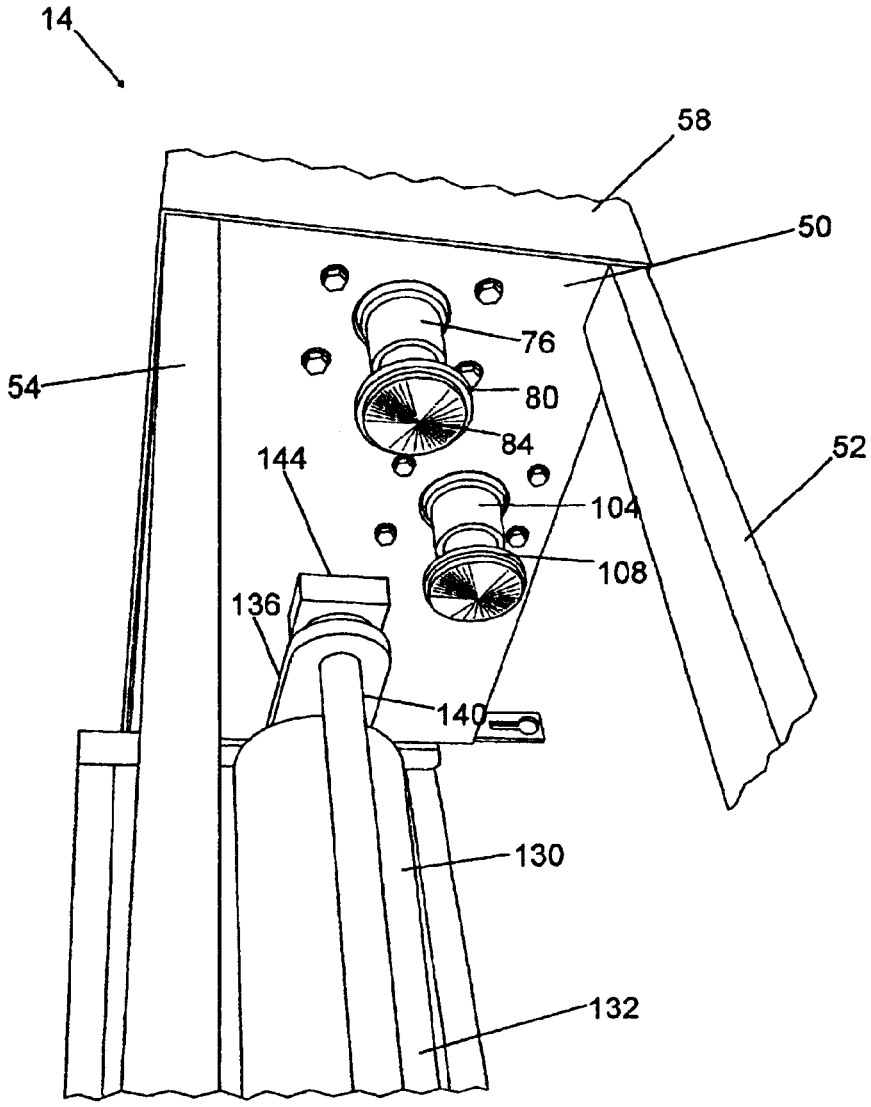
FIG. 8 is a fragmentary perspective view of the cleaner of FIG. 2 with components removed to show detail with the left-hand side being the downstream side.
Figure 9:
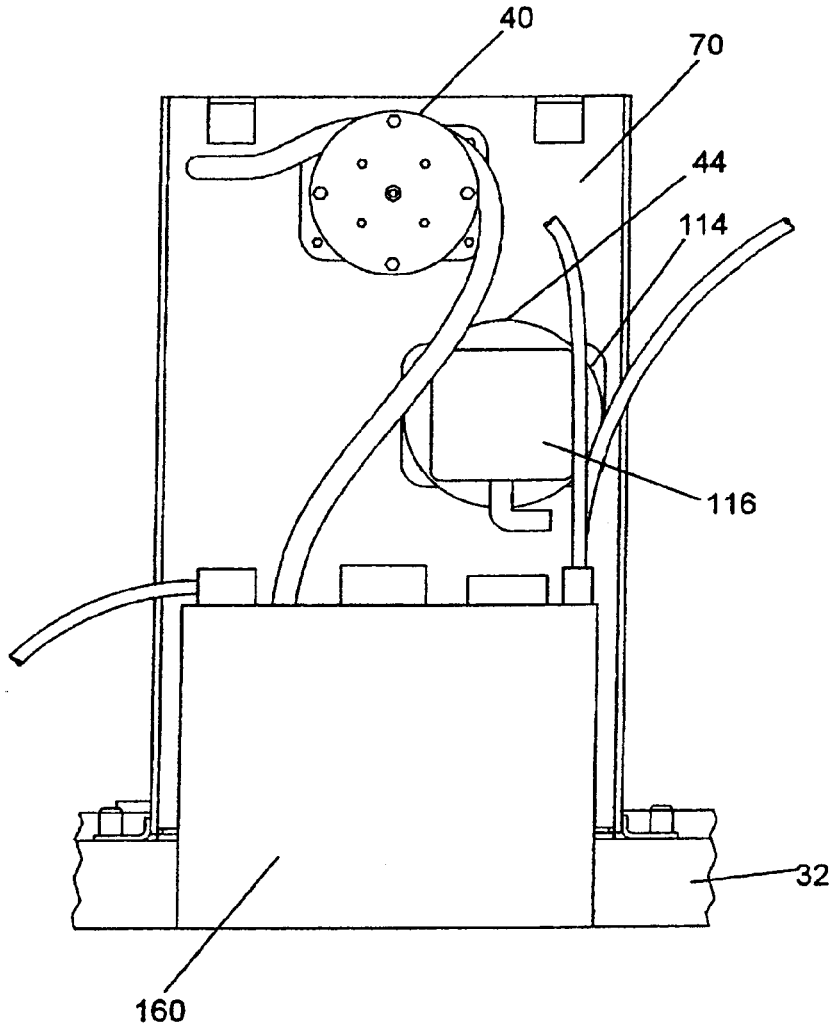
FIG. 9 is a schematic end elevation view of the cleaner of FIG. 2 illustrating details of the towel supply mechanism and electrical junction box.
Figure 10:
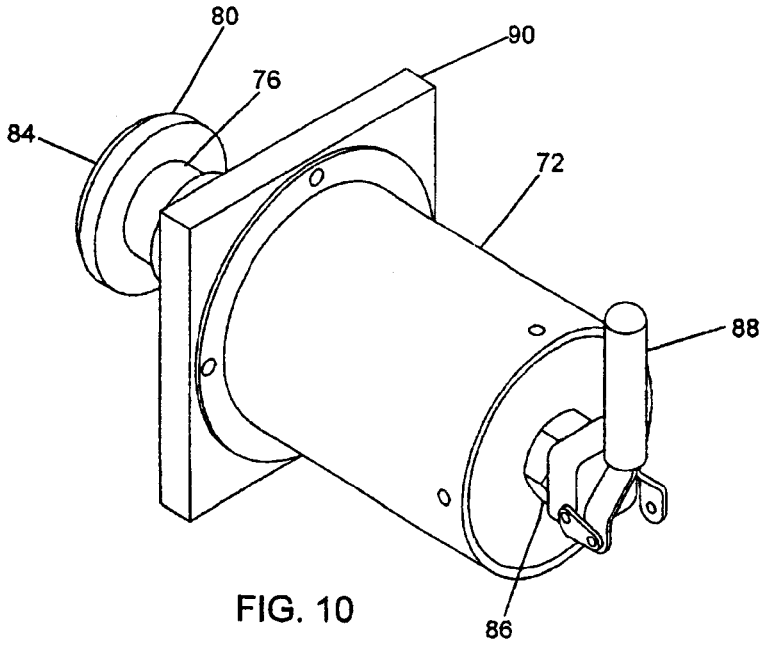
FIG. 10 is a perspective view of a support for mounting one end of either shaft of the wiping material supply mechanism.

In a preferred embodiment shown in FIG. 5, the frame 38 includes uprights 48, 50 at opposite ends thereof and adapted to be mounted on the conveyor 16. The uprights 48, 50 are mounted to permit easy removal of the cleaner 14 from the apparatus 10. Frame members 52, 54 are secured to and extend between the uprights 48, 50 to maintain the uprights in spaced relationship and form the integral structure frame 38. The uprights 48, 50 form a wall of housings or enclosures 56, 58 respectively. Each enclosure is secured to the uprights in any suitable manner, such as with screws 60. Housing 56 bears control buttons or switches of known variety to signal up, down and inching movements of roller 130 for wiping, lifting or indexing of the towel material 42.

Figure 12:
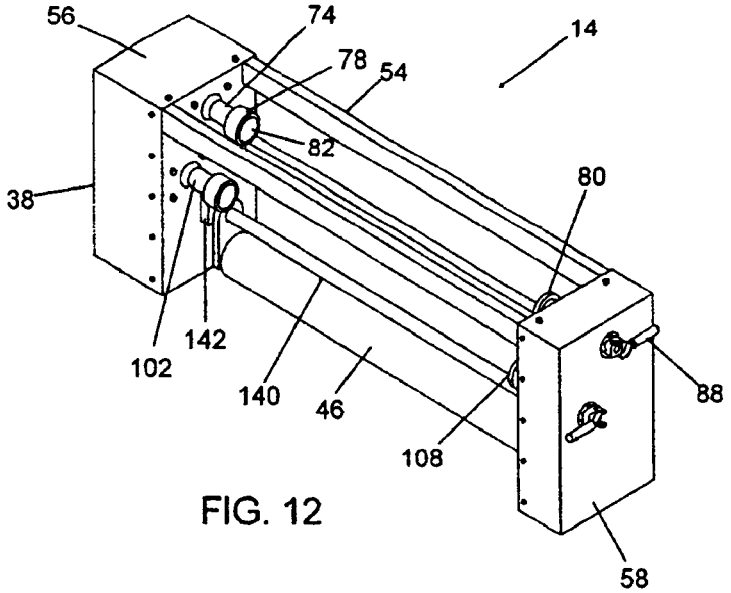
FIG. 12 is a perspective view of the cleaner of FIG. 2 with components removed to show details of the cleaning station viewed from the upstream side.
Figure 13:
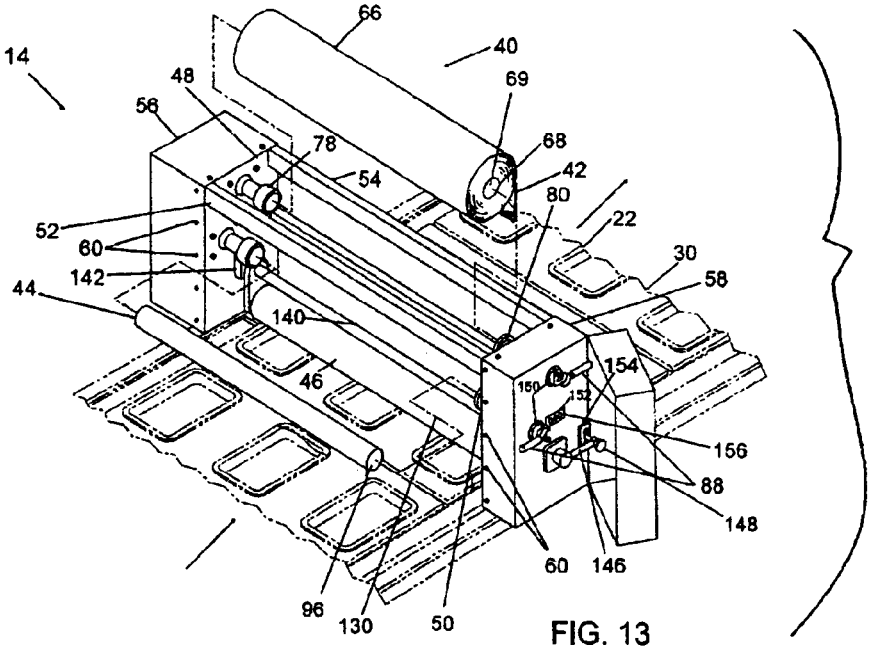
FIG. 13 is an exploded perspective view of the cleaner of FIG. 2 shown from the upstream side with the presser in the receptacle engaging position.
Figure 14:
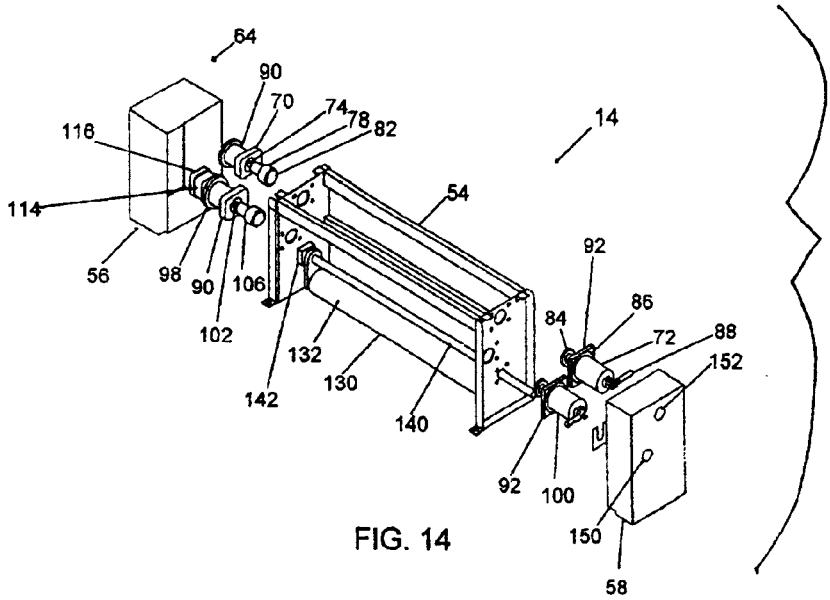
FIG. 14 is an exploded perspective view of the cleaner of FIG. 2 showing the components used for mounting a towel supply and towel take-up.

The supply mechanism 40 can be in any suitable form or configuration that allows the feeding of towel material 42 to the take-up mechanism 44. Preferably, the supply 40 is a roll of towel material 42. The towel material 42 can be paper-based, and therefore disposable, or cloth that can be laundered for reuse. In a preferred embodiment, the supply 40 includes a roll 66 of towel material 42. As is illustrated in FIGS. 12–14, roll 66 is substantially cylindrical with the towel material 42 being wrapped around a tube 68. The tube 68 provides a through-bore 69 extending between opposite ends of the roll 66. Such rolls of towel material are well known in the art. The tube 68 is generally helically wrapped paperboard onto which towel material 42 is wrapped in a spiral pattern. Alternatively the take-up spool tube 68 can be reusable stainless steel, or other material.

The roll 66 is mounted for rotation on the frame 38 and is suspended between opposing supports 70, 72. Supports 70, 72 support shafts 74, 76, respectively, on which roll engaging heads 78, 80, projecting into and toward the center of the frame 38, are mounted. On the free end of the heads 78, 80 are protuberances 82, 84 wherein the spacing between the protuberances is generally the same as the length of the roll 66. The protuberances 82, 84 each extend into a respective end of the tube 68 to suspend the roll 66 in the frame 38. The spacing between the heads 78, 80 is selected to provide the appropriate pressure to the ends of the roll 66. The shafts 74, 76 and heads 78, 80 may be resiliently biased, for example by a spring, to facilitate removing spent rolls and installing new towel rolls. The use of a resilient biasing member will help accommodate rolls having different lengths while still providing good contact of the heads 78, 80 with the tube 68.

Figure 11:
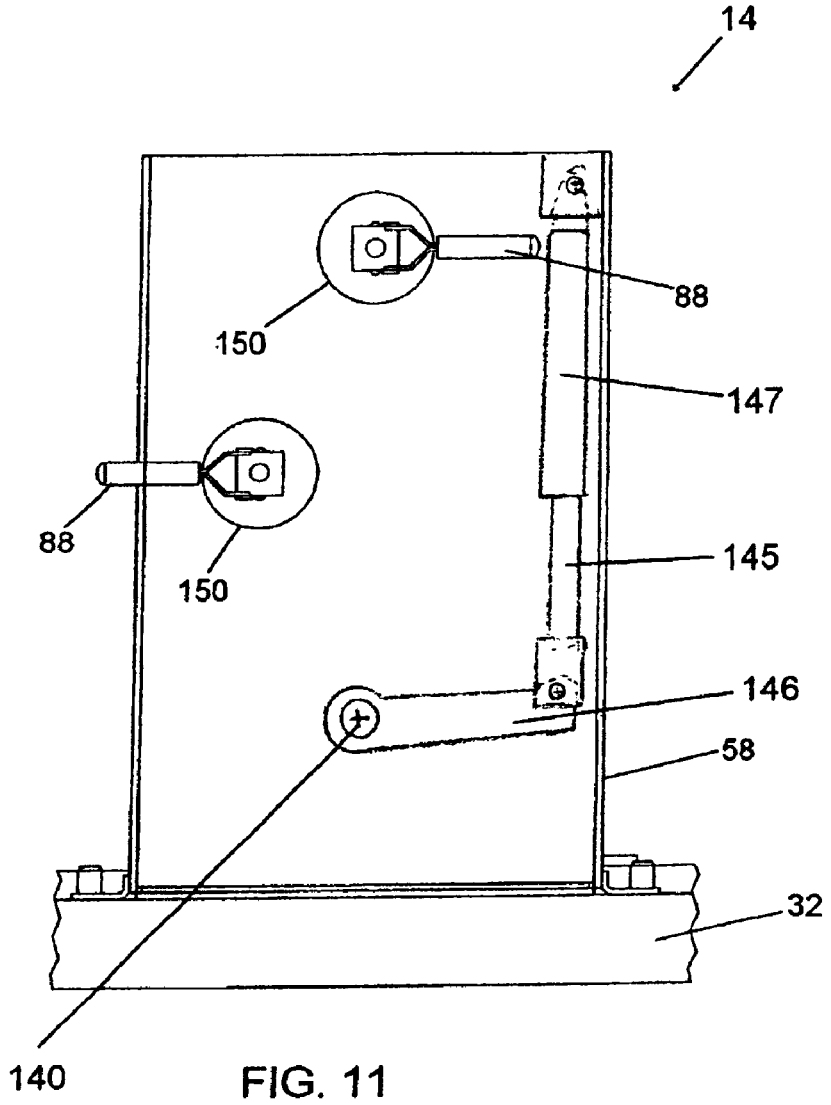
FIG. 11 is an end elevation view of the cleaner of FIG. 2 showing the release mechanisms for the towel supply and towel take-up material and for a device used to selectively move the presser between a pressing position and a retracted position.

At least one of the supports 70, 72 can be provided with a mechanism, designated generally 86, having a pivotal handle 88 connected to the respective shafts 74, 76 and head 78, 80. Handles 88 extend laterally outwardly through respective holes 150 in housing 58 cleaner 14, as seen in FIG. 11. Movement of the handle 88 results in retraction of the heads 78, 80 to increase the distance between the heads 78, 80. The supports 70, 72 have transversely extending flanges 90, 92 for securing the supports to a respective upright 48, 50 with fasteners (not shown). The heads 78, 80 and shafts 74, 76 may be rotatable to reduce friction during driving of the roll 66, as hereinafter described. In the alternative, the heads 78, 80 and shafts 74, 76 may be stationery whereby friction between the tube 68 and the heads 78, 80 will serve as a brake to resist rotation of the roll 66 during operation of the cleaner 14. The supports 70, 72 can be mounted inside the enclosure 56, 58. The handles 88 project through respective openings 150.

The take-up mechanism 44 is mounted on the frame 38 and is adapted for accumulating used towel material 42. The take-up mechanism 44 includes means to support a take-up magazine such as a spool 96 that is mounted between the uprights 48, 50 for rotation of the spool about its longitudinal axis to accumulate towel material 42 taken from the roll 66. The spool 96 is supported by supports 98, 100, shafts 102, 104 and heads 106, 108, as described above for the support of the roll 66. One of the supports 70 includes a power-operated drive 114 operable to drive the spool 96 for towel take-up. However, it is to be noted that other forms of power-operated drives can be provided for driving the spool 96. In the illustrated structure, only one drive 114 is illustrated but a plurality of drives could be used. In the illustrated structure, the drive 114 includes a power-driven actuator that preferably is a rotary motor 116. The motor 116 can be a pneumatic or electric motor. The motor 116 is connected to the shaft 102 to effect rotation thereof and of the spool 96. Interlocked, keyed engagement between the head 106 and the spool 96 effects rotation of the spool and take-up of towel material 42 from the supply 40. The spool 96 may be mounted or removed from between the supports 98, 100. The release and securing of spool 96 is accomplished by actuation of the handle 88 on the supply 40. The spool 96 may be driven continually, or only when towel material 42 is in contact with one or more receptacles 22.

Figure 15:
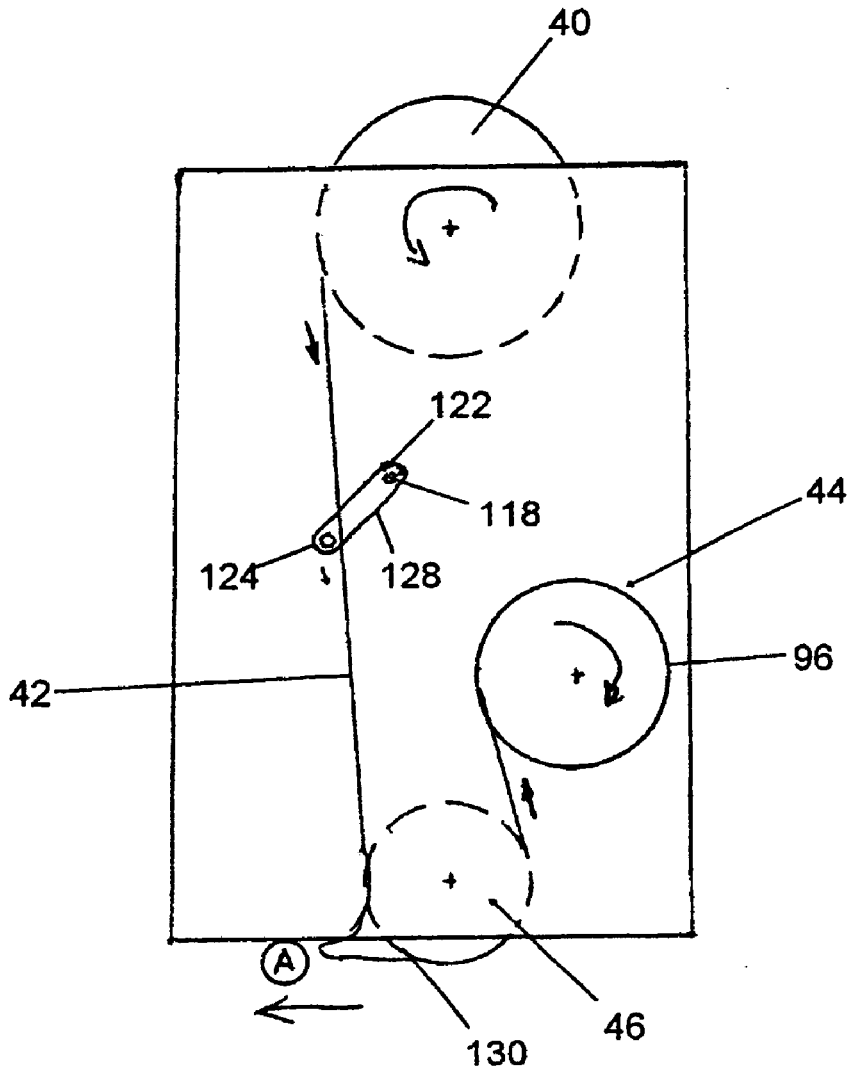
FIG. 15 is a schematic vertical sectional view of the cleaner of FIG. 2 illustrating the slack take-up mechanism.

In a preferred alternative embodiment, cleaner 14 includes an idler bar mechanism, illustrated in FIG. 15, to maintain tension on the towel material 42. The mechanism includes an idler shaft 118 mounted to the supports 48, 50 at pivot points 122, by any suitable method. The idler shaft 118 supports arms 128 on opposed ends of the shaft. The arms 128 support idler bar 124 at free ends of arms 128. Towel material 42 is threaded between idler shaft 118 and idler bar 124 as the towel material 42 moves from supply 40 and engaging mechanism 46. As gravity causes idler bar 124 to move downwardly, the idler bar contacts towel material 42 to maintain tension and prevent towel material from becoming loose on engaging mechanism 46 as the upper edge surfaces of trays 22 passing beneath the cleaner 14, in the direction indicated by arrow A in FIG. 15, are wiped clean.

The presser 46 is provided to urge towel material 42 into contact with the receptacle surfaces 26 as the receptacles 22 advance from the deposition station 12 to the assembly station 18. By relative movement between the towel material 42 and surfaces 26, debris and contaminants can be at least partly wiped from the surface 26 so than an effective heat sealing between the cover 24 and receptacle 22 can be achieved. Presser 46 preferably includes a resiliently deformable roller 130 having an exterior layer of material 132 (see FIG. 6) that may be deformed in a resilient manner when the receptacle 22 contacts towel material 42 passing under and around a portion of the roller 130. Soft material 132 is preferably a closed-cell polymer foam, for example polyethylene sponge rubber, although any material with similar characteristics may be utilized.

The roller 130 is mounted for rotation about its longitudinal axis on an arm arrangement that includes arms 134, 136 positioned at each end of the roller 130. The roller 130 may have bearings journaled onto shaft 138 projecting from arms 134, 136 inwardly toward the central area of the cleaner 14. In the alternative, the roller 130 may have a shaft projecting from each end that could be journaled into bearings mounted in each of the arms 134, 136. The arms 134, 136 are mounted on shaft 140 that is rotatably mounted at each end to upright 48, 50 such as by insertion through a receptive bearing block 142, 144 that is secured to a respective upright 48, 50. The longitudinal axis of the shaft 140 is spaced from the longitudinal axis of the roller 130. By rotation of the shaft 140, the roller 130 may be selectively moved between a lowered position, as seen in FIG. 14, and a raised position. By raising the roller 130, a new supply of towel material may be mounted on the cleaner 14.

In the illustrated preferred structure of FIG. 11, a lever arm 146 is mounted on shaft 140. Lever arm 146 is attached, for example, by a clevis to an end of a rod 145 of a pneumatic cylinder 147, which is mounted to the adjacent frame upright. By actuating the pneumatic cylinder, the pivot shaft is caused to rotate, thus raising or lowering the roller. This actuation can be accomplished in an alternative manual mode to assist in towel loading (e.g. by the mechanism illustrated in FIGS. 5 and 13), or automatically (via the pneumatic mechanism shown in FIG. 11) to raise the roller if a misplaced receptacle is present. This provides a space (not shown) for an operator to thread the towel material 42 from a roll 66 under the roller 130 to the take-up spool 96.

Figure 13A:
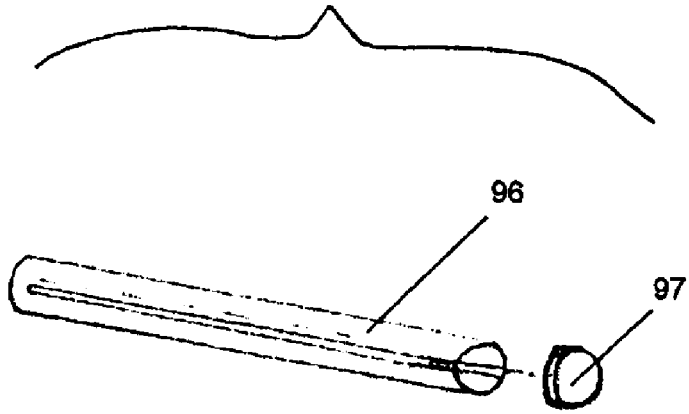
FIG. 13A is an enlarged exploded view of the take up tube of FIG. 13.

In a preferred embodiment illustrated in FIG. 13A, spool 96 is formed from a stainless steel tube, with one end closed. The closed end is designed to engage with the towel take-up drive. Two longitudinal slits are located on each side of the tube. The towel material 42 is inserted through the slits of the tube, then a plastic end cap 97 is placed over the open end of the tube to secure the towel. By rotating the spool, the towel is captured on the spool. In an alternative embodiment, the take-up spool can be a tube 68 from a used roll 66.

The take-up mechanism 44 is on the upstream side of the apparatus 15 while the supply 40 is on the downstream side. This may be reversed if desired. In order to prevent or reduce unwanted towel material 42 from being removed from the take-up mechanism, the take up cylinder is ratcheted to prevent the cylinder from rotating backwards. The pneumatic actuator rotator prevents from moving forward when actuator is not rotating. The supply brake (not seen), located within the supply spool, is an internally assembled disc brake plastic cylinder pad on the end of a screw. An external screw is turned to put pressure on the supply spool. This brake can be adjusted to prevent the towel from freely unspooling.

A suitable controller is provided and is preferably mounted in the control box 159 of the sealing machine 18. The controller 158 may be pneumatic or electrical and a particularly preferred controller is an electrical controller model PLC Modicon from Schneider Electric, Andover, Md. The controller 158 is operable to control the advancement of towel material 42 from the supply 40 to the take-up mechanism 44 after a predetermined amount of advancement of the conveyor element 30. A conventional sensor (not shown) provides a signal indicative of receptacle advancement from the food deposition station 12 to the assembly station 18. This can be accomplished by any suitable method, including the use of photoelectric cells and micro-switches. Also, the sensor may be operably associated with the motor 34 driving the conveyor element 30. A signal is provided to the controller 158 indicative of the number of receptacles advanced and/or the location of receptacles 22 relative to roller 130. Based on the received signal, the controller 158 controls the valve or valves (not shown) that control operation when motor 116 is a pneumatic motor.

When a predetermined number of receptacles have passed under the roller 30 for cleaning, the controller will activate the motor 116 to advance the towel material 42 from the roll 66 to the take-up mechanism 44. Advancement of the towel material may be incremental or may be continuous, as desired. In one embodiment the advancement is incremental and the towel material can advance between incremental movements of the conveyor 16. Towel material advancement is preferably in the range of between about ½ inch to about 2 inches, and more preferably about ½ inch to about 1 inch during each incremental advancement of the towel material. A fresh or clean area of towel material 42 is thereby provided for cleaning the surfaces 26 of receptacles 22 subsequently passing through the cleaner 14.

A method for packaging food is also provided. The method includes placing food material 20 either in bulk or discreet pieces into respective receptacles 22 at the deposition station 12. There may be multiple rows and columns of receptacles 22 on the conveyor 16 in an upwardly opening orientation. The filled receptacles 22 are then advanced from the deposition station 12 to the cleaner 14. The towel material 42 will engage the surfaces 26 as the receptacles pass under the towel material positioned on the underside of the roller 130. Simple physical engagement with relative movement between the receptacle and towel material has been found to be effective in removing sufficient material to permit the secure application of a cover 24 to the top of the receptacle 22. Once the rim or upper surface 26 has been cleaned, the receptacle 22 with food 11 therein is advanced to the assembly station 18. At the assembly station, cover material 24 is positioned over the rim or surface 26 and is urged into engagement with the surface 26. The cover 24 is then adhered to the surface 26 by any suitable method, including adhesive or heat sealing. The receptacle 22 may be evacuated of air and back-flushed with an inert gas, typically nitrogen, before or while the cover is secured in place. Excess cover material may be trimmed from the cover 24 before or during the securing of the cover, as is well known in the art. In a preferred embodiment receptacle 22, cover 24 and food therein are advanced to an area within the assembly station 18 to apply heat to effect heat shrinking of the cover 24 to reduce or eliminate wrinkles and make the cover taut.

After the heat shrinking, the packaged food is ready for shipment under appropriate storage conditions to a retailer or a distribution center.

From the foregoing description, those skilled in the art will appreciate that all the aspects of the present invention have been disclosed. The present invention provides an apparatus for automatically wiping sealing surfaces of food receptacles, such as meat trays. The wiping is accomplished by engaging the sealing surface that is typically the upper rim of the receptacle with absorbent materials, such as paper or cloth towel. A supply of towel material is provided which extends partially around a presser that urges the towel material into engagement with the sealing surface for physically removing at least some of the contaminants or debris from the sealing surface. The presser is resiliently deformable to provide good contact between the towel material and the sealing surface without damaging the tray or towel material. A drive is provided to advance the towel material from the supply to a take-up mechanism upon receiving a signal from a controller if incremental advancing of the towel material is desired. Continuous take-up of the towel material may also be provided if desired. A controller is operably connected to drive means that controls advancing of the towel material under power. A brake mechanism cooperates with the towel material to help control the amount of towel material that is advanced during operating of the wiping apparatus.

The present invention also provides for a method of packing food, including feeding receptacles to a filling station where food is deposited into the receptacles. The filled receptacles are then advanced to a cleaning station where the cover engaging surface is mechanically wiped for cleaning by absorbent material, such as paper or fabric toweling. The thus cleaned receptacles are advanced to a cover applying station at which a cover is secured to each of the receptacles to provide a sealed container. The towel material can be advanced from time to time, to provide a clean towel portion to assist in cleaning subsequently advanced filled receptacles. The receptacles may be gas flushed prior to securing the cover to the receptacle.

Thus there have been shown and described embodiments of a method and apparatus for a food packaging cleaner, which method and apparatus fulfill all of the objects and advantages sought therefore. As evident from the foregoing description, certain aspects of the present invention are not limited by the particular details of the examples illustrated herein, and it is therefore contemplated that many changes, modifications, variations and other uses and applications of the present invention, including equivalents thereof, will become apparent to those skilled in the art after considering this specification and the accompanying figures. All such changes, modifications, various and other uses and applications which do not depart from the spirit and scope of the invention are deemed to be covered by the invention which is limited only by the claims which follow.

What is claimed is:

1. A cleaning apparatus for cleaning a portion of at least one container, the apparatus comprising a conveyor for advancing at least one container a container cleaner including a wiping material supply mechanism to support a supply of wiping material, an engaging mechanism operable to urge the wiping material from the supply mechanism into contact with the portion of the container to be cleaned, a wiping material take-up mechanism adapted to store the wiping material from the supply mechanism after the wiping material has contacted the containers, a drive operable to effect movement of the wiping material from the supply mechanism to the take-up mechanism, a sensor operable to sense container advancement and further operable to provide a signal indicative of a number of containers that have advanced, and a controller operable to receive and interpret said signal and said controller operably associated with the drive to effect advancement of the wiping material from the supply mechanism to the take-up mechanism responsive to said signal after a predetermined container advancement number is indicated.

2. The cleaning apparatus of claim 1 wherein the drive is operable to automatically advance the wiping material from the supply mechanism to the engaging mechanism and to the take-up mechanism as the container is conveyed.

3. A food packaging apparatus including:

a conveyor operable for advancing food receptacles in an upwardly opening orientation from a filling station to a sealing station;

a receptacle cleaner positioned between the filling station and the sealing station, the cleaner including a wiping material supply mechanism to support a supply of wiping material, an engaging mechanism operable to urge the wiping material from the supply mechanism into contact with an upper rim of each of the food receptacles passing thereunder, a wiping material take-up mechanism adapted to store the wiping material from the supply mechanism after the wiping material has contacted the food receptacles, a drive operable to effect movement of the wiping material from the supply mechanism to the take-up mechanism, a sensor operable to sense receptacle advancement and further operable to provide a signal indicative of a number of receptacles that have advanced, and a controller operable to receive and interpret said signal and said controller operably associated with the drive to effect advancement of the wiping material from the supply mechanism to the take-up mechanism responsive to said signal after a predetermined receptacle advancement number is indicated.

4. The food packaging apparatus, as set forth in claim 3, wherein the drive is operable to automatically advance the wiping material to the engaging mechanism.

5. The food packaging apparatus, as set forth in claim 4, wherein the engaging mechanism includes a resiliently deformable member that engages the wiping material to urge the wiping material into contact with the food receptacles passing under the deformable member.

6. The food packaging apparatus, as set forth in claim 5, wherein the deformable member includes a substantially cylindrical polymeric foam element with a longitudinal axis extending substantially across the conveyor.

7. The food packaging apparatus, as set forth in claim 3, wherein the supply includes a roll of the wiping material mounted on a first carrier for rotation, a portion of the wiping material passing under and around a portion of the cleaning mechanism.

8. The food packaging apparatus, as set forth in claim 7, including a brake mechanism cooperating with the wiping material on a feed side of the cleaning mechanism to maintain tension in at least a portion of the wiping material on the feed side of the cleaning mechanism.

9. The food packaging apparatus, as set forth in claim 8, wherein the brake mechanism acts on said roll of the wiping material.

10. The food packaging apparatus as set forth in claim 7 wherein the take-up mechanism includes a second carrier and removable take-up spool mounted thereon, and a drive cooperating with a portion of the second carrier and operable to drive the take-up spool to advance the wiping material from the first carrier to a presser for take up on the take-up spool.

11. A food packaging machine, including:

a receptacle filling station operable for placing food into receptacles, the receptacles having sealing surfaces;

a sealing station operable for securing a cover material onto the sealing surfaces of the receptacles thereby forming sealed containers;

a conveyor operable for transporting filled receptacles from the filling station to the sealing station;

a receptacle cleaner positioned between the filling station and the sealing station, the cleaner, including a first carrier, a roll of towel material rotatably mounted on the first carrier, a presser including a resiliently deformable member overlying and extending substantially across the conveyor and mounted for rotation and having a portion of the towel material passing thereunder and partially therearound and operable to effect engagement of towel material with the sealing surfaces passing under the presser, a towel material take-up mechanism operable to store towel material after towel material has contacted sealing surfaces of receptacles, a power drive associated with the take-up mechanism and operable to selectively transfer towel material from the roll to the take-up mechanism and a brake operable to resist movement of towel material from the roll to the take-up mechanism, a sensor operable to sense receptacle advancement and further operable to provide a signal indicative of a number of receptacles that have advanced, and a controller operable to receive and interpret said signal and said controller operably associated with the drive to effect advancement of the towel material from the supply mechanism to the take-up mechanism responsive to said signal after a predetermined receptacle advancement number is indicated.

12. The food packaging machine, as set forth in claim 11, wherein said brake is operable to resist movement of towel material from the roll to the presser.

13. The food packaging machine, as set forth in claim 11, wherein the controller and drive are operable to effect incremental movement of towel material from the roll to the take-up mechanism.

14. A food packaging machine including:

a receptacle filling station operable for placing food into receptacles;

a sealing station operable for securing cover material onto each of the receptacles each having a sealing surface;

a conveyor operable for transporting receptacles from the filling station to the sealing station; and a cleaner positioned adjacent the conveyor downstream of the filling station and upstream of the sealing station, the cleaner, including a first carrier, a roll of towel material rotatably mounted on the first carrier, a presser, including a resiliently deformable member overlying and extending generally across the conveyor and mounted for rotation and having a portion of the towel material passing thereunder and partially there around and operable to effect engagement of towel material with the sealing surfaces passing under the presser, a towel material take-up mechanism operable to store towel material after towel material has contacted sealing surfaces of receptacles, a power drive associated with the take-up mechanism and operable to selectively transfer towel material from the roll to the take-up mechanism, a brake operable to resist movement of towel material from the roll to the take-up mechanism, and a sensor operable to sense receptacle advancement and further operable to provide a signal indicative of a number of receptacles that have advanced, and a controller operable to receive and interpret said signal and said controller operably associated with the drive to effect advancement of the towel material from the supply mechanism to the take-up mechanism responsive to said signal after a predetermined receptacle advancement number is indicated.

* * * * *